US006666815B2

(12) United States Patent
Costanzo et al.

(10) Patent No.: US 6,666,815 B2
(45) **Date of Patent: *Dec. 23, 2003**

(54) MOVABLE CANOPY FOR AN INFANT CARE UNIT

(75) Inventors: Joseph A. Costanzo, Sellersville, PA (US); John L. Eble, Bensalem, PA (US); Felix J. Gryn, Lansdale, PA (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/833,486

(22) Filed: Apr. 12, 2001

(65) Prior Publication Data

US 2002/0072649 A1 Jun. 13, 2002

Related U.S. Application Data

(63) Continuation-in-part of application No. 09/732,644, filed on Dec. 8, 2000.

(51) Int. Cl.[7] ..... A61G 11/00
(52) U.S. Cl. ..... 600/22
(58) Field of Search ..... 600/21–22; 5/97; 128/205.26

(56) References Cited

U.S. PATENT DOCUMENTS

| | | | | |
|---|---|---|---|---|
| 3,782,362 A | | 1/1974 | Puzio | |
| 3,858,570 A | | 1/1975 | Beld et al. | |
| 4,206,523 A | | 6/1980 | James | |
| 4,750,474 A | | 6/1988 | Dukhan et al. | |
| 5,119,467 A | | 6/1992 | Barsky et al. | |
| 5,285,519 A | | 2/1994 | Barsky et al. | |
| 5,308,310 A | * | 5/1994 | Roff et al. | 600/21 |
| 5,453,077 A | * | 9/1995 | Donnelly et al. | 600/22 |
| 5,759,149 A | * | 6/1998 | Goldberg et al. | 600/22 |
| 5,817,002 A | * | 10/1998 | Donnelly et al. | 600/22 |
| 6,022,310 A | | 2/2000 | Goldberg et al. | |
| 6,036,634 A | * | 3/2000 | Goldberg et al. | 600/22 |
| 6,296,606 B1 | * | 10/2001 | Goldberg et al. | 600/22 |

FOREIGN PATENT DOCUMENTS

| | | |
|---|---|---|
| EP | 0 291 195 | 11/1988 |
| EP | 0 308 093 | 3/1989 |
| EP | 0 619 995 B1 | 10/1994 |
| WO | 97/11663 | 4/1997 |

OTHER PUBLICATIONS

Ohmeda, The Ohio® IC Incubator, "*Unlimited Access. Uncompromised Thermal Care.*", four pages, 8/97.

* cited by examiner

*Primary Examiner*—John P. Lacyk
(74) *Attorney, Agent, or Firm*—Barnes & Thornburg

(57) ABSTRACT

An infant care unit includes an infant-support platform, a canopy, and a mounting assembly that couples the canopy to the platform. The mounting assembly allows movement of the canopy about a vertical axis between a plurality of positions, one of which is a central position having the canopy overlying the platform.

27 Claims, 12 Drawing Sheets

FIG. 7
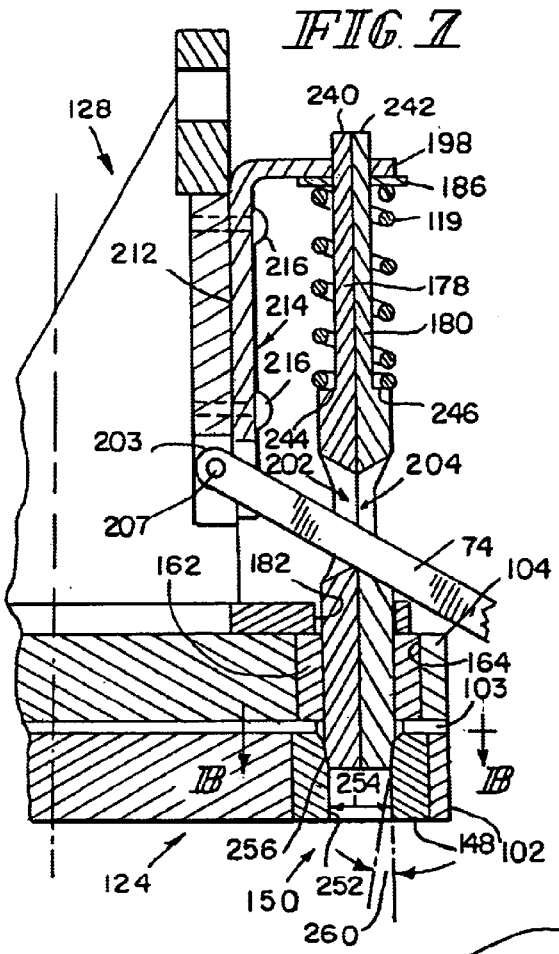
FIG. 6
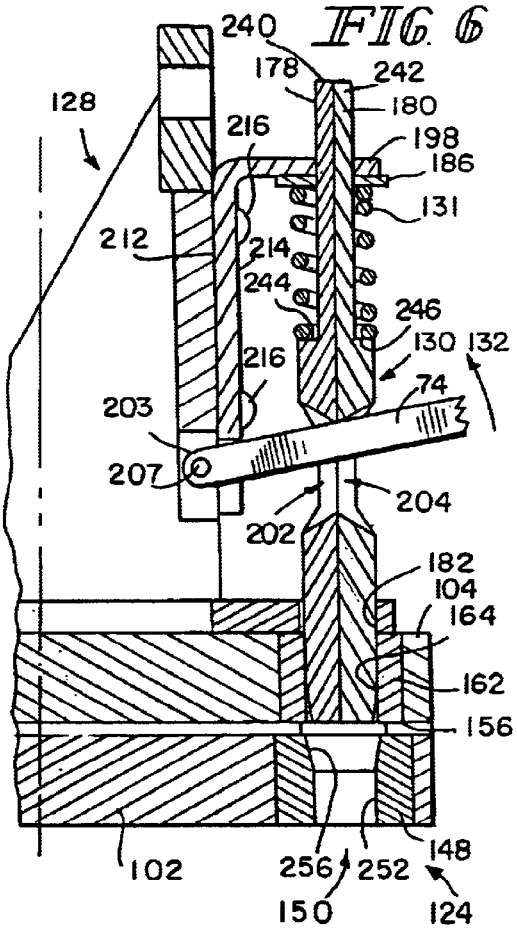
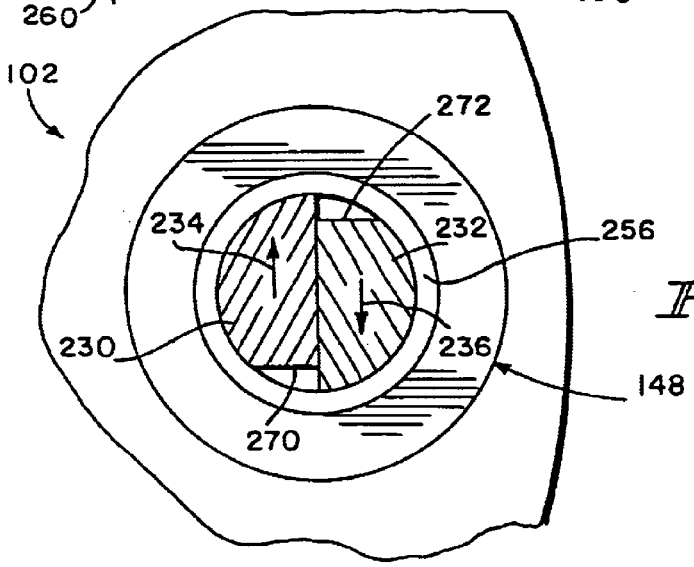
FIG 9

MOVABLE CANOPY FOR AN INFANT CARE UNIT

RELATED APPLICATION

The present application is a Continuation-in-Part of U.S. patent application Ser. No. 09/732,644, filed Dec. 8, 2000, the complete disclosure of which is hereby expressly incorporated by reference.

TECHNICAL FIELD

The invention relates to infant care units of the type comprising a base with an infant-support surface above the base and either or both a canopy and a warmer located over the infant-support surface.

BACKGROUND AND SUMMARY

Infant care units, such as an infant incubator that includes an isolation chamber and various systems that maintain the isolation chamber at a controlled temperature and humidity to facilitate the development of a premature infant, are known. Such incubators conventionally include an infant-support surface for supporting the infant in the isolation chamber and some type of overhead structure, such as a canopy, above the infant-support surface. In some cases, the isolation chamber is encompassed by a set of panels arranged around the infant-support surface. The canopy cooperates with these panels to enclose the isolation chamber. Conventionally, access openings through which caregivers gain access to the infant are provided in either the canopy or in the panels. Such incubators may include canopies that have access doors to provide further access to the infant.

The isolation chamber will often include air circulation systems that provide controlled movement of air within the isolation chamber. The canopy is oftentimes arranged to direct the flow of air within the isolation chamber. It is, therefore, important for the canopy to be aligned over the patient-support surface to properly direct the flow of air. In addition, it is desirable for the canopy to be aligned with the set of panels that encompass the isolation chamber to minimize air and heat losses between the panels and the canopy.

The caregiver, however, may desire to have substantially unrestricted access to the infant for a myriad of reasons, including observation and/or treatment. Though incubators of the conventional type, that include canopies with access doors, are vertically adjustable, or separate and pivot, providing access to the infant, they do not provide completely uninhibited access to the infant. The canopy itself is still positioned directly above the infant even if portions of it are moved for access. If the incubator includes a warmer in lieu of, or in addition to, the canopy over the infant, that too, will obstruct access to the infant.

It would be desirable, therefore, to provide an incubator that includes a canopy and an apparatus for moving the canopy from above of the infant-support surface, thus, allowing unrestricted access to the infant by the caregiver.

Accordingly, an infant care unit and method for accessing an infant therein by allowing unrestricted access to same are provided. The unit includes a canopy movable between a central position directed at a platform upon which an infant rests, and a position spaced therefrom. In one illustrative embodiment, an overhead arm is disposed relative to the platform to have a central position. The overhead arm is also movable between the central position to a position spaced therefrom. Another illustrative embodiment includes a mechanism for locking either or both the overhead arm and the canopy in their central position when they are returned from the position spaced therefrom.

Another illustrative embodiment of the infant care unit includes a combination incubator and infant warmer that comprises a radiant heater and a canopy. The incubator and infant warmer include a generally vertical support adjacent a platform. The radiant heater is mounted on the vertical support for movement about the platform. The heater has a central position directed at the platform and retracted positions away from the platform. The canopy is movable with the heater and is configured to provide a closed space directed at the platform. A mechanism is also provided for releasably locking the heater in the central position.

Another illustrative embodiment of the infant care unit is provided which includes a patient support apparatus comprising a base, a patient support platform, an overhead arm and a mounting assembly. The patient support platform is carried by the base. The overhead arm is located generally above the patient support platform. The mounting assembly couples the overhead arm to the base for pivoting movement relative thereto. The pivoting movement is in a second plane that is generally parallel to a first plane which is defined by the patient support platform.

Another illustrative embodiment of the infant care unit is provided which includes a mounting assembly attached to a base and a canopy. The assembly also includes a pivot mechanism configured to permit movement of the canopy laterally in a plane above a patient support between a central position and a position spaced therefrom. The mounting assembly has upwardly extending telescoping members supporting the canopy in its lower use position and its upper spaced-apart position. In addition, the assembly includes a lock mechanism. The illustrative lock mechanism is configured to permit the canopy to move laterally when the canopy is extended upwardly to its upper spaced-apart position. The lock mechanism also comprises a structural member that is attached to the mounting assembly. The structural member is engagable with the pivot mechanism when the canopy is in its lower use position for preventing lateral movement of the canopy.

Another illustrative embodiment comprises a plate that is attached to the canopy. The plate is rotatable about a vertical axis relative to the base. In addition, a notch is formed in the plate. A stop member is provided that is engagable with the notch when the canopy is in the central position. The stop member may be configured to be urged into the notch when the canopy is in the central position.

Another illustrative embodiment of the infant care unit is provided which includes a patient support and canopy for isolating an infant. The canopy is engaged with the patient support forming an isolation chamber and defining a central position. A means for disengaging and moving the canopy between an upper spaced-apart position from the patient support and a lowered use position is provided. A means for supporting the canopy for movement between the central position and a position spaced therefrom when the canopy is in the upper spaced-apart position is also provided.

Another illustrative embodiment of the infant care unit is provided which includes a patient support apparatus comprising a base, a patient support platform, an overhead arm and a mounting assembly. The patient support platform is carried by the base. The overhead arm is located generally above the patient support platform. The mounting assembly couples the overhead arm to the base for pivoting movement relative thereto. The mounting assembly comprises a stationary first plate and a second plate. The second plate is movable relative to the first plate in a second plane that is generally parallel to a first plane defined by the infant-support platform.

A method is provided for accessing an infant in an infant care unit. The infant care unit provides a platform upon which the infant rests and a canopy positioned above the platform forming an isolation chamber that defines a central position. The method comprises the steps of raising the canopy upwardly relative to the platform between a lower use position and an upper spaced-apart position, and moving the canopy in a plane above the platform between the central position and a position spaced therefrom.

Additional features and advantages of the infant care unit will become apparent to those skilled in the art upon consideration of the following detailed descriptions exemplifying the best mode of carrying out the apparatus as presently perceived.

BRIEF DESCRIPTION OF THE DRAWINGS

The illustrative apparatus will be described hereinafter with reference to the attached drawings which are given as non-limiting examples only, in which:

FIG. 6 is a side cross-sectional view of the swing bracket assembly of the unit along lines A—A of FIG. 4 shown in the movable position;

FIG. 7 is a side cross-sectional view of the swing bracket assembly of the unit along lines A—A of FIG. 4 shown in the locked "home" position;

FIG. 9 is a top cross-sectional view of the split pin and pivot plate bore of the support along lines B—B of FIG. 7;

Corresponding reference characters indicate corresponding parts throughout the several views. The exemplifications set out herein illustrate various embodiments of the apparatus and such exemplifications are not to be construed as limiting the scope of this application in any manner.

DETAILED DESCRIPTION OF THE DRAWINGS

Figure 1:
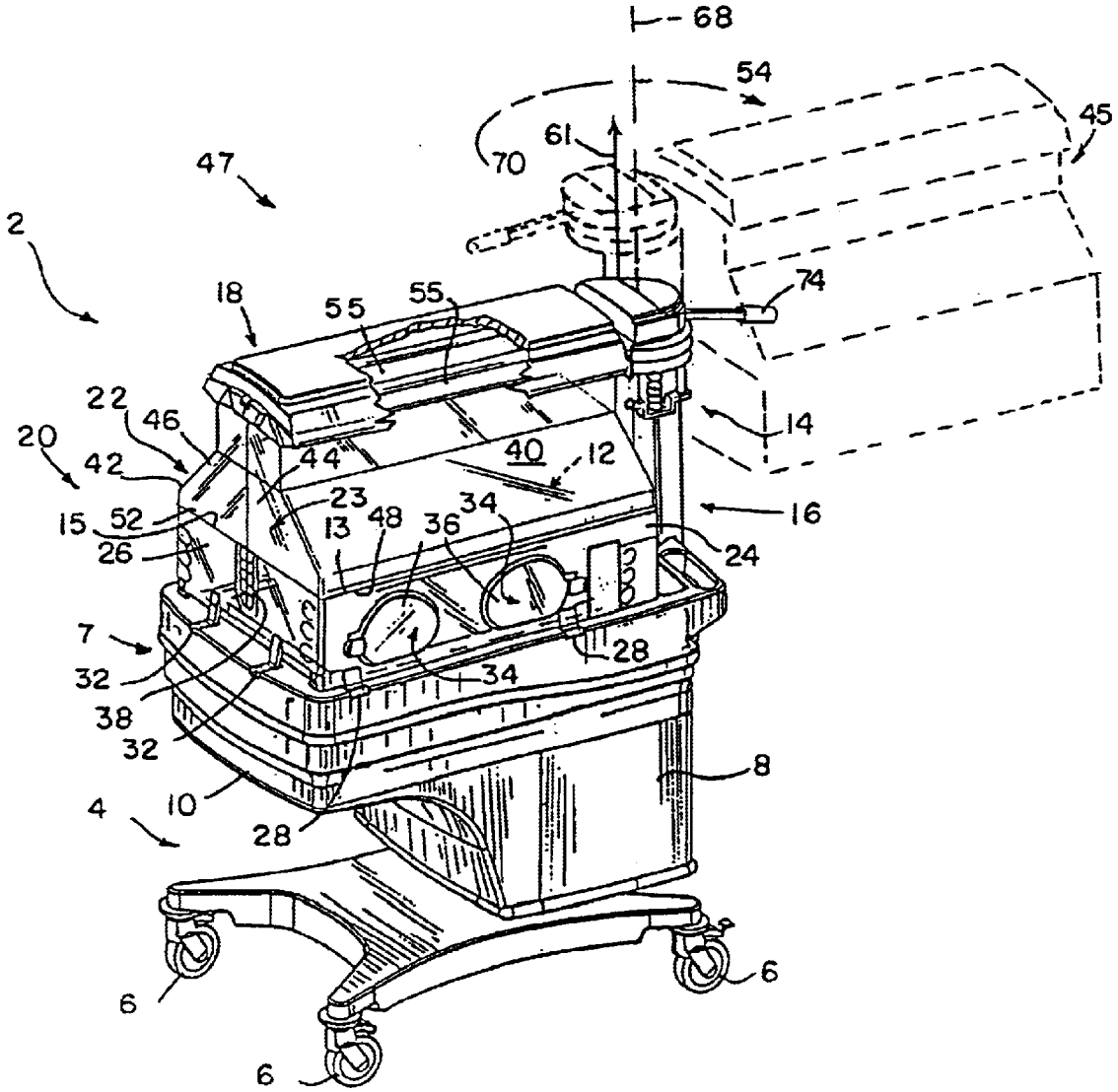
FIG. 1 is a perspective view of an infant care unit.

An infant care unit or incubator 2 includes a base 4, a plurality of castors 6 supporting base 4, and an infant support 7 supported above base 4 as shown in FIG. 1. Infant support 7 includes a pedestal 8 coupled to base 4 for vertical movement, a platform tub 10 supported by pedestal 8, and a support surface (not shown) positioned in platform tub 10.

A pair of transparent side guard panels 24 and a pair of transparent end guard panels 26 extend upwardly from platform tub 10 having top edges 13 and 15 disposed generally coplanar. Side and end guard panels 24, 26 cooperate with canopy halves 22, 23 and overhead arm 18 to define an isolation chamber 12. Panels 24 include hinges 28 that are also attached to platform tub 10 allowing a caregiver to pivot panels 24 downwardly away from canopy 20 providing side access to an infant within chamber 12. End guard panels 26 also include hinges 32, which also pivot downwardly for access to the infant in chamber 12.

A pair of access ports 34 is provided on side guard panels 24. Ports 34 are normally closed by access port covers 36. Access port covers 36 can be removed to allow access to the infant in chamber 12 while isolated in unit 2.

At least one end guard panel 26 is formed to include at least one pass-through grommet 38. Wires and tubes (not shown) can be routed into chamber 12 through pass-through grommet 38.

A canopy support arm assembly 14 includes a telescoping vertical arm 16 and the horizontal overhead arm 18. Canopy 20 is coupled to overhead arm 18 and is positioned above platform tub 10. It is contemplated that overhead arm 18 includes a warmer 55 directing heat to either the infant or the canopy. (See FIG. 1.) Canopy halves 22, 23 are coupled to overhead arm 18 for pivoting movement between raised and lowered positions. Each canopy half 22, 23 comprises side faces 40, 42, and adjacent end faces 44, 46, respectively. Edges 48, 50, 52 of faces 40, 42, 46, respectively, are disposed generally coplanar and positioned adjacent each other. It is contemplated that the edges between the canopy and the sides are configured to produce a fit for preventing a substantial amount of warm air from escaping.

As shown in FIG. 1, canopy 20 is rotatable in the horizontal plane about axis 68, as indicated by reference numerals 54, 70. Canopy 20, thus, no longer obstructs access to isolation chamber 12 when moved to a spaced-apart position shown by hatched lines 45. Canopy 20 is also shown in FIG. 1 in its central or home position indicated by reference numeral 47. Home position 47 is defined as the location where canopy 20 covers isolation chamber 12 such that edges 48, 50, 52 of halves 22, 23 mate with edges 13, 15 of side and end panels 24, 26. It is contemplated that a stop mechanism can be added to prevent canopy 20 from rotating 180 degrees from home position 47. This prevents the possibility of cable running between overhead arm 18 and vertical arm 16 from being twisted and damaged.

Other features of patient-support apparatus 20 are discussed in detail in U.S. Pat. No. 6,022,310, titled "Canopy Adjustment Mechanisms for Thermal Support Apparatus," which is incorporated herein by reference.

Figure 2:
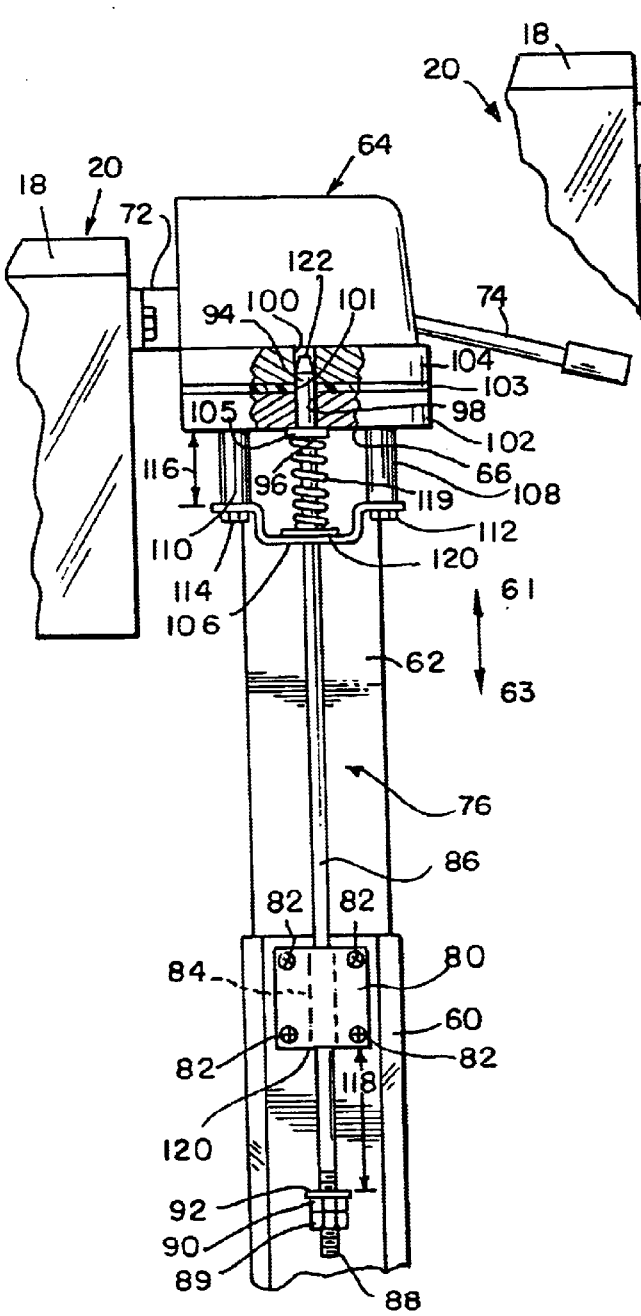
FIG. 2 is a side and partial cross-sectional view of the arm assembly from the unit of FIG. 1 shown in the lowered position.
Figure 3:
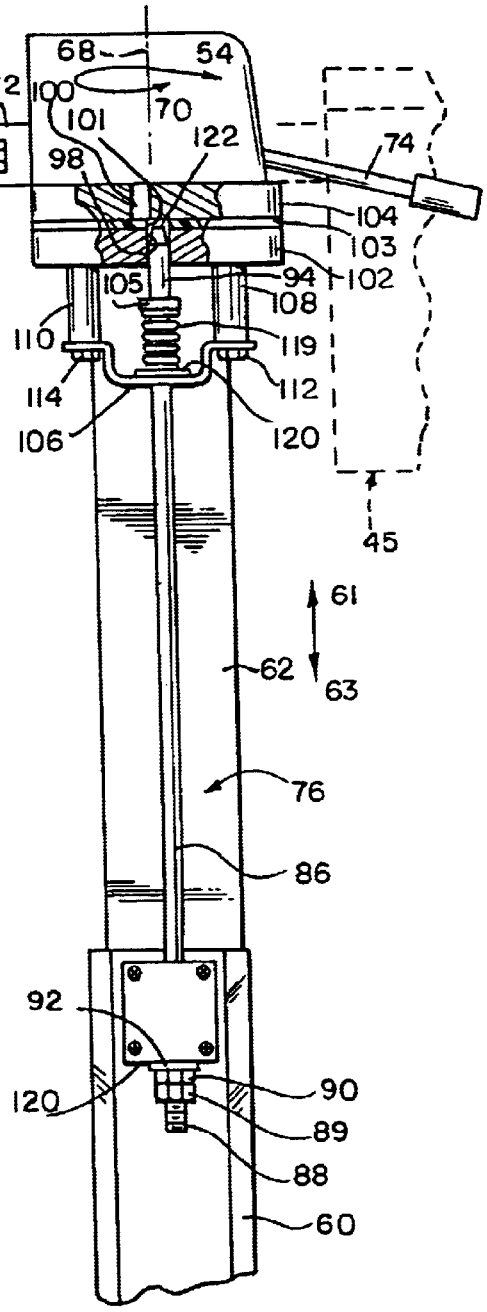
FIG. 3 is a side and partial cross-sectional view of the arm assembly from the unit of FIG. 1 shown in the raised position.
Figure 4:
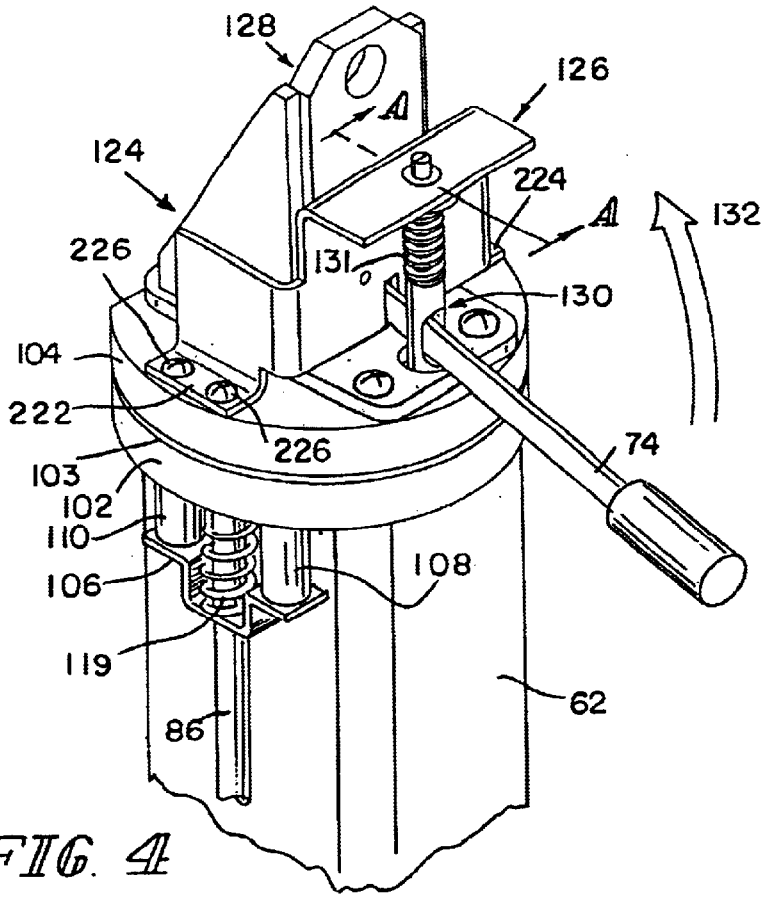
FIG. 4 is a perspective view of the swing bracket assembly from the unit of FIG. 1.

In the illustrated embodiment, canopy support arm assembly 14 includes a telescoping vertical member 16 and horizontal overhead arm 18. As shown in FIG. 2, member 16 comprises outer and inner telescoping members 60, 62. The range of motion available to member 16 in directions 61, 63 is appreciated by comparing FIGS. 2 and 3. A hub 64 is positioned aloft end 66 of inner member 62. As shown in FIGS. 1 and 3, hub 64 is rotatable about axis 68 relative to tub 10 in directions 54, 70. Canopy 20 is coupled to hub 64 via a bridge 72. Bridge 72 is a conduit for receiving wires for coupling of same between canopy 20 or overhead arm 18 and the rest of unit 2. A lever 74 extends from hub 74 which, when engaged, allows canopy 20 to move in directions 54, 70.

It is contemplated that to rotate canopy 20, it should not contact an infant inside chamber 12. Rather, canopy 20 should clear side and end guard panels 24, 26, or otherwise not interfere with isolation chamber 12. Accordingly, inner member 62 is movable upwardly in direction 61. In addition, a stop mechanism assembly 76 is coupled to both members 60, 62 for preventing canopy 20 from rotating unless member 16 has raised in direction 61 sufficiently a distance 118. (See FIG. 2.) As shown in both FIGS. 2 and 3, assembly 76 comprises a block 80 attached to member 60 by four bolts 82. A bore 84 is vertically disposed through block 80. A rod 86 extends through bore 84. End 88 of rod 86 is a threaded end. Two nuts 89, 90 and washer 92 are shown attached to threaded end 88. Opposite end 88, an end pin 94 is formed at end 96 of rod 86 selectively extending through bores 98, 100, 101 disposed through plates 102, 104 and bearing spacer 103 of hub 64. (See cross-sectional views in FIGS. 2 and 3.) A retaining ring 105 extends from the periphery of end pin 94 for limiting the length with which end pin 94 can extend through bores 98, 100, 101. Rod 86 also extends through a bracket 106. Opposed spacers 108, 110 are attached to bracket 106 via bolts 112, 114. Spacers 108, 110 space bracket 106 apart from plate 102 a distance 116. A bias member or spring 119 is positioned about rod 86 between retaining ring 105 and washer 120 adjacent bracket 106.

In operation, plate 104 is movable about axis 68 on bearing spacer 103 relative to plate 102, as shown in FIG. 3. As depicted in FIG. 2, however, member 62 has not been raised a distance 118. Accordingly, bias from spring 119 acts on end pin 94 maintaining same within bores 98, 100, 101. End pin 94, thus, blocks the movable path of plate 104, which, therefore, prevents canopy 20 from moving about axis 68, thereby maintaining its home position 47. This measure prevents a caregiver from inadvertently pivoting canopy 20 away from tub 10 while an infant is inside causing contact without first raising canopy 20 a distance 118 above isolation chamber 12 and the infant.

However, when member 62 is raised a sufficient height, defined by a distance greater than length 118 between the lower edge 120 of block 80 and washer 92, end pin 94 is retracted from bore 100 allowing plate 104, and, thus, canopy 20, to move about axis 68. (See FIG. 3.) Once member 62 has moved upwardly in direction 61 a length 118, washer 192 engages edge 120. As member 62 travels in direction 61 a distance greater than length 118, rod 86 is prevented from moving. Consequently, the continued upwardly movement of member 62 causes bracket 106 to compress spring 119 and plate 104 to rise above tip 122 of end pin 94. Once tip 122 is removed from bore 100, plate 104 is free to move about axis 68.

When canopy 20 is returned over tub 10 to its home position 47, it is contemplated that this is a precise location over tub 10 so as to properly mate canopy 20 with side and end panels 24, 26. To move canopy 20 and arm 18, they are attached to a swing bracket assembly 124 positioned on end 66 of member 62. (See FIGS. 4 and 5 through 7.) Assembly 124 comprises plates 102, 104 with bearing surface 103 positioned therebetween, a lever 74, a pin bracket 126, a coupling bracket 128, a split pin 130, and a spring 131. By moving lever 74 in direction 132, split pin 130 is lifted from bores 150, 164 of bushings 148, 162 in plates 102, 104 and surface 103. This frees plate 104 and provides canopy 20 unrestricted movement in directions 54, 70 relative to plate 102.

Figure 5:
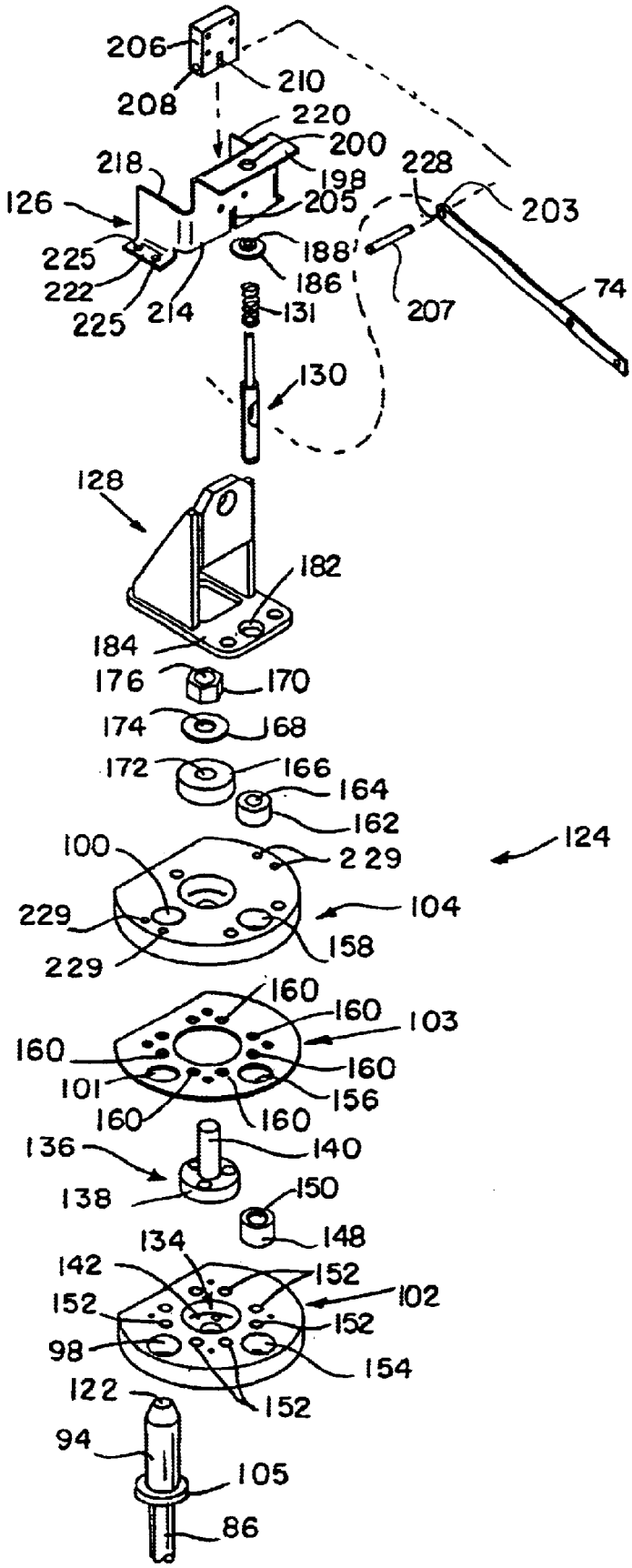
FIG. 5 is an exploded view of the swing bracket assembly from the unit of FIG. 1.

An exploded view of assembly 124 is shown in FIG. 5. Base plate 102 includes a centrally located bore 134 configured to receive the base 138 of bearing post 136. In the illustrated embodiment, bore 134 is not disposed through the entirety of plate 102, rather, a bottom surface 142 is provided upon which base 138 is supported. A shaft 140 extends upwardly from post 136 configured to extend through bores 144, 146 of bearing surface 103 and plate 104, respectively. A base plate bushing 148 having a bore 150 is received in bore 154 and is configured to receive pin 130. (See also FIGS. 6 and 7.) Bushing 148 is illustratively made of steel as is pin 130. It is appreciated, however, that other materials may be used for bushing 148.

Base plate 102 is attached to end 66 of member 62 via pins or bolts extending through bolt holes 152 disposed through plate 2. FIG. 5 shows pin bore 98 disposed through plate 102 and coaxially aligned with bores 100, 101 for receiving end pin 94 that extends upwardly therethrough. A plurality of bores 160 are disposed through bearing surface 103 and co-axially aligned to bores 152 for receiving the pins or bolts for secure bearing surface 103 to plate 102. Thus, plate 102 and bearing surface 103 being fixed relative to member 62, and bearing post 136 provide smooth surfaces against which pivot plate 104 rotates. End pin 94 extends through bores 98, 100, 101, to prevent such movement. In addition, roller bearing, 166 thrust washer 168, and hex nut 170 all include apertures 172, 174, 176 through which shaft 140 also extends.

Figure 8:
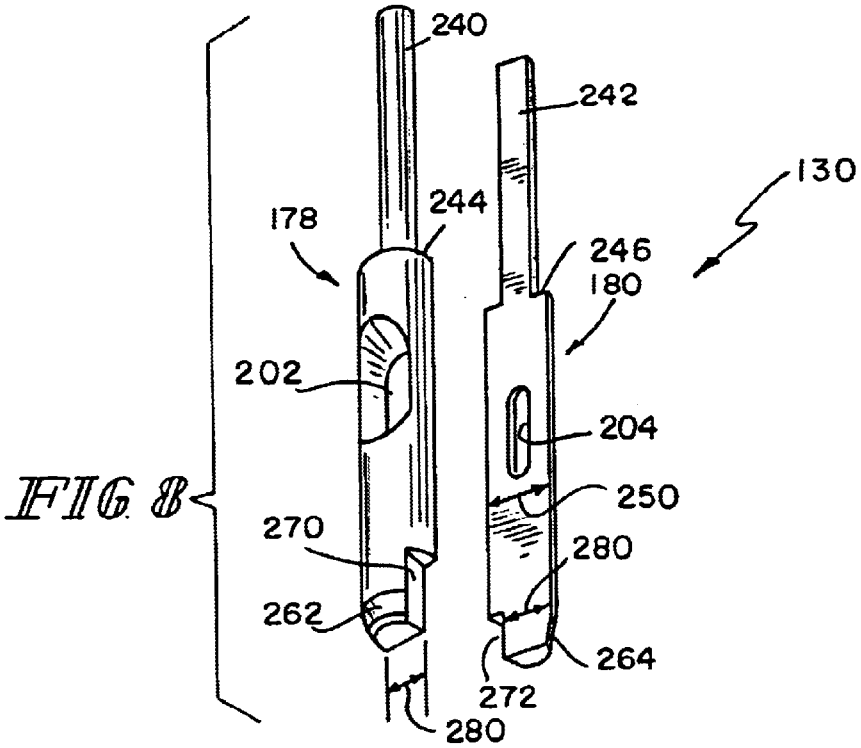
FIG. 8 is a perspective view of the two portions of the split pin from the unit of FIG. 1.

Another bushing 162, similar to bushing 148, is positioned in bore 158 and includes its own bore 164 configured to receive pin 130. Both bushings 148, 162 are sized to receive split pin 130. As depicted in FIG. 8, split pin 130 comprises two divided portions 178, 180. Both portions 178, 180 extend through bores 150, 164 to lock hub 64 into place against bushing 148. (See also FIGS. 6, 7 and 9.) It is contemplated that bores 154, 156, 158 and 150, 164 are positioned on plates 102, 104, bushing 103 and bushings 148, 162 to define home position 47 of canopy 20. As depicted in FIG. 5, pin 130 is configured to extend through aperture 182 disposed through base 184 of coupling bracket 128. It is further contemplated that bores 150, 164 have different cross-sections to produce a tight fit with pin 130 for maintaining home position 47 of canopy 20. (See again, FIGS. 6, 7 and 9.)

Split pin 130 is disposed through spring 131 and extends through apertures 188, 200 of bushing 186 and panel 198. Lever 74 extends through openings 202, 204 of pin portions 178, 180, respectively, and is pivotally fixed to pin 207 at end 203, thus, serving as a cantilever. End 203 extends through a slot 205 in face plate 214 and into a slot 210 of block 206. A pin 207 extends through aperture 228 which is disposed through end 203 of pin 74. Pin 207 also extends through bore 208 which is disposed through a bore 208. Block 206 is attached to the rear side 212 of face plate 214 of bracket 126 via screws 216. (See FIGS. 6 and 7.)

Extending transversely from face panel 214 are side panels 218, 220. Extending outwardly from the lower-most extent of panels 218, 220 are flanges 222, 224 having apertures 225 disposed therethrough. Apertures 225 are sized to receive a screw or bolt 226 for securely attaching bracket 126 to pivot plate 104. (See also FIG. 4.) Accordingly, bores 229 are also disposed through pivot plate 104 configured to receive bolts 226.

During operation, moving canopy 20 first requires that it be raised in direction 61 as shown in FIGS. 2 and 3. Canopy 20 can then be rotated in either direction 54 or 70 by moving lever 74 in direction 132 and by applying a force against the canopy 20 in either direction 54 or 70. (See FIGS. 1, 4, and 6.) Moving lever 74 in direction 132, pin 130 is caused to be removed from bushings 148, 162, thereby releasing pivot plate from any obstruction and allowing it to move freely. It is contemplated that swing bracket assembly 124 will move canopy 20 between its home position 47 over tub 10 and its spaced-apart position 45 away from tub 10. The home position 47 of canopy 20 forms proper mating between edges 48, 50, 52 of canopy halves 22, 23 and edges 13, 15 of end and side panels 24, 26.

The operation of swing bracket assembly 124 placing canopy 20 in the precise home position 47 over side and end panels 24, 26 are shown in FIGS. 6–9. Assembly 124 is shown in its locked position, for example, in FIGS. 7 and 9. This locked position indicates that canopy 20 is in its home position 47. The locked position is defined as pin 130 extending through bushings 148, 162. To ensure the precise location of canopy 20, pin 130 must fit precisely into, specifically, bore 150 of bushing 148 allowing no tolerance or gap between pin 130 and bore 150. Split pin 130 with its two portions 178, 180 is best shown in FIG. 8. Tips 230, 232 of portions 178, 180 are each biased in directions 234, 236, respectively, eliminating any gap between pin 130 and bushing 148 that might affect the precise positioning of canopy 20. (See FIG. 9.)

In the illustrated embodiment, FIG. 6 shows lever 74 extending through openings 202, 204 in the raised position. Tips 230, 232 are removed from both bushings 148, 162 which allows pivot plate 104 to move relative to base plate 102, as previously discussed. Spring 131 is positioned about the narrow portions 240, 242 and abutting ledges 244, 246 of pin 131 biasing same downwardly in direction 248. Raising lever 74 in direction 132 creates a resistance force against the bias of spring 131. Accordingly, when lever 74 is released, the bias directs split pin 130 downwardly into bushings 148, 162.

Assembly 124 is shown in FIG. 7 with split pin 130 extending through bores 150, 164 of bushings 148, 162, thus locking canopy 20 at its home position 47. To prevent any gap from existing between pin 130 and, specifically, bore 150, portions 178, 180 of pin 130 have a larger diameter 250 than the inner diameter 254 of the first portion 252 of bore 150 of bushing 148. (See also FIG. 8.) Furthermore, a second portion 256 of bore 150 is wider than diameter 280 of portions 178, 180. A five (5) degree bevel 260 is provided between the first and second portions 252, 256 for mating with corresponding five (5) degree bevels 262, 264 on portions 178, 180. Because diameter 250 of portions 178, 180 is greater than diameter 254 of bore 150, notches 270, 272 are disposed at their lower ends. Accordingly, each end 230, 232 of each portion 178, 180 has a lesser diameter 280 than diameter 254 of bushing 148. The difference between diameters 250 and 280 in combination with bevels 262, 264 and 261 creates lateral forces 234, 236 each directed outwardly forcing bevels 262, 264 adjacent the bevel of portion 256. Accordingly, no tolerance or gap exists between bevels 262, 264 of pin 130 and the bevel of portion 256 of bore 150. This creates a precise and repeatable mating of canopy 20 with sides 22, 24 at its home position 47.

It is contemplated that angle 260 can be any angle sufficient to assist in effecting forces 234, 236 outwardly. Such an angle is dependent on the material used for the pin and bushing with the desire that any frictional force created by the mating of the pin and bushing does not cause the pin to become stuck in the bushing. Furthermore, it is contemplated that other pin-type devices or other apparatus that effectively locks canopy 20 in a precise home position, by eliminating the possibility of a tolerance or gap between an apparatus and a corresponding receptacle can be used.

Figure 10:
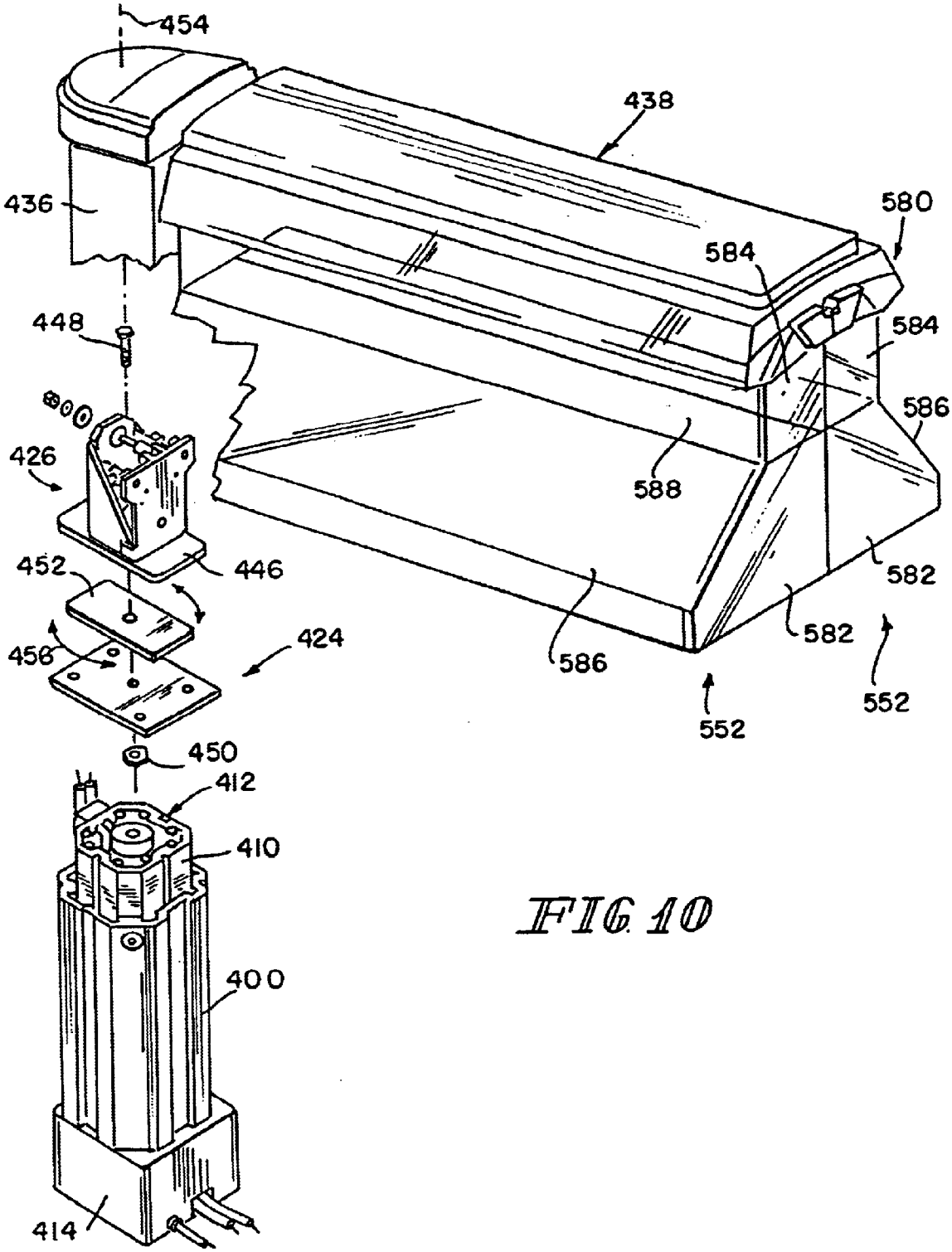
FIG. 10 is an exploded perspective view of a canopy support arm and mounting assembly.

Vertical arm 436 includes an outer tubular column 400, an inner tubular column 410, and a telescoping drive assembly 412 as shown in FIG. 10. Drive assembly 412 includes a motor (not shown) encased by a motor housing 414 and a telescoping lead screw that extends and retracts in response to actuation of the motor encased by motor housing 414.

As shown in FIG. 10, the alignment mechanism 426 includes a bottom plate 446 which is pivotably mounted to plate 424 by a bolt 448 and nut 450 about axis 454. A bearing plate 452 is located between plates 424 and plate 446. Plate 424 is coupled to the tubular column 410. The mounting assembly shown in FIG. 10 permits rotation of the overhead arm 438 about an axis 454 extending through the telescoping arm 436. Therefore, as plate 446 and bearing 452 rotate relative to plate 424 as shown by arrows 456, the overhead arm 438 rotates about axis 454 relative to the patient support 7. (See also FIG. 1.) Therefore, the overhead arm 438 can be rotated about axis 454 to an out-of-the-way position relative to patient support 7.

As also shown in FIG. 10, the canopy halves 552 include end panels 582 which are coupled to cover 580 by extension sections 584. Canopy halves 552 also include an angled transparent surface 586 and inwardly extending top portions 588. Top portions 588 engage each other to provide an enclosure around the patient support surface which is spaced apart from the overhead arm 438.

Figure 11:
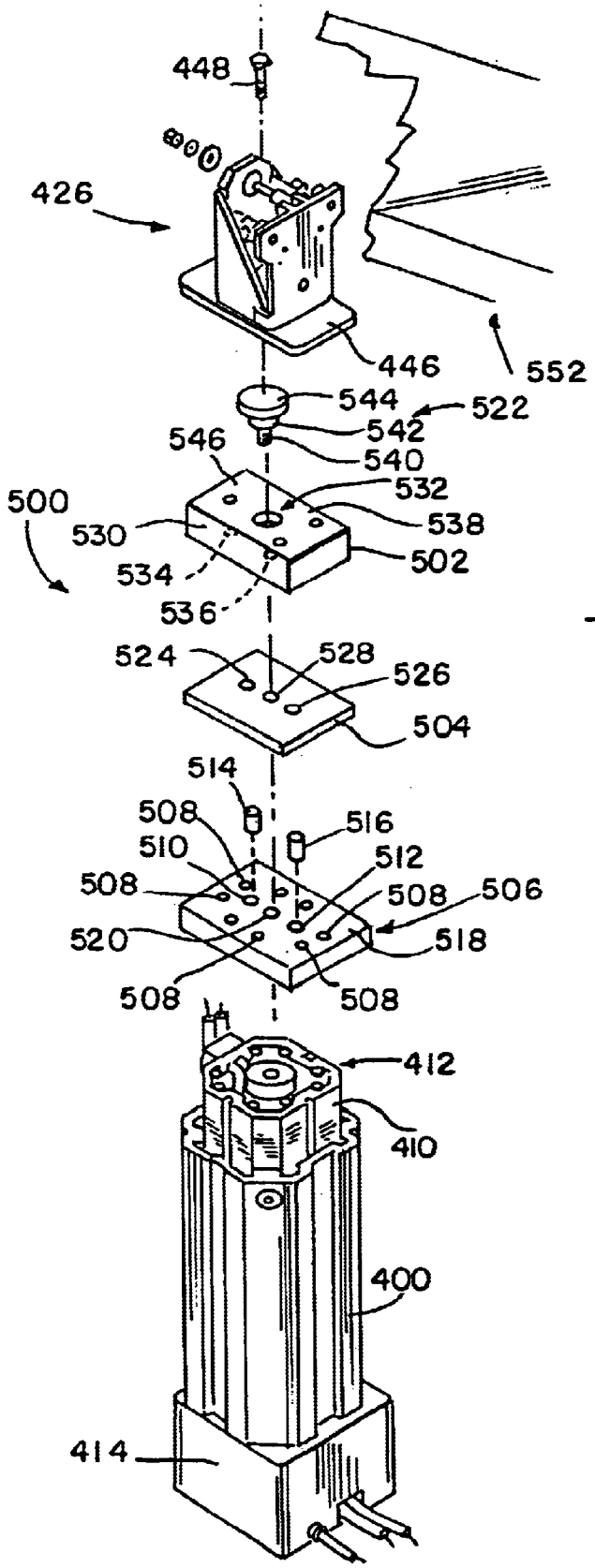
FIG. 11 is an exploded perspective view of a canopy support arm and mounting assembly including another embodiment of a home-position apparatus.

Another embodiment of a home position apparatus for use with an infant care unit is shown in FIG. 11, and is indicated by reference numeral 500. Device 500 includes a swivel plate 502, a bearing pad 504 and a stationary block 506. Block 506 is attached to column 410. Illustratively, screws (not shown) extend through bores 508 which are disposed through block 506 to attach block 506 to column 410. The pattern of bores 508 is dependent on the pattern of corresponding bores in column 410. Bores 510, 512 are configured to receive plungers 514, 516 configured to extend slightly from top surface 518 of block 506. A central bore 520 is disposed in block 506, illustratively between bores 510, 512. It is contemplated, however, that bore 520 may be placed in other positions on block 506. Bore 520 is configured to receive shoulder screw 522.

Bearing pad 504 comprises two plunger holes 524, 526 as well as a central hole 528. Holes 524, 526 are configured to receive the ends of plungers 514, 516. Central hole 528 is configured to receive shoulder screw 522. Pad 504 is attached to top surface 518 of block 506, thus, providing a smooth surface upon which lower surface 530 of plate 502 can pivot.

Plate 502 has a central bore 532 disposed there through configured to receive shoulder screw 522. Bores 532, 528 and 520 are coaxially aligned such that when shoulder screw 522 is disposed through each bore, block 502 pivots about screw 522 relative to the infant support. Specifically, the threaded end 540 of screw 522 engages corresponding threads (not shown) in bore 520 of block 506. This engagement attaches screw 522 to block 506. A bearing surface 542 on screw 522 allows the surfaces of hole 528 of pad 504 and bore 532 of plate 502 to pivot there about. A cap 544 extends beyond the diameter of bearing surface 542 and seats within a recess 546 in bore 532 to secure plate 502 to apparatus 500.

Two detents 534, 536, are provided on the lower surface 530 of plate 502 and are configured to receive the ends of plungers 514, 516, respectively. Because plate 446 is configured to attach to the top surface 538 of plate 502, as plate 502 pivots relative to the infant support, so too does the canopy halves 552. (See also FIG. 10.) Detents 534, 536 are coaxially aligned with holes 524, 526 and plungers 514, 516, respectively, and are positioned relative to the position of the canopy halves 552 to define a home position. Accordingly, when canopy halves 552 pivot to this home position, plungers 514, 516 will extend upwardly through holes 524, 526 and engage detents 534, 536, respectively. This engagement, holds plate 502 in position relative to block 506 to produce a reproducible stop position indicating to the caregiver that canopy halves 552 are in the home position.

Figure 12:
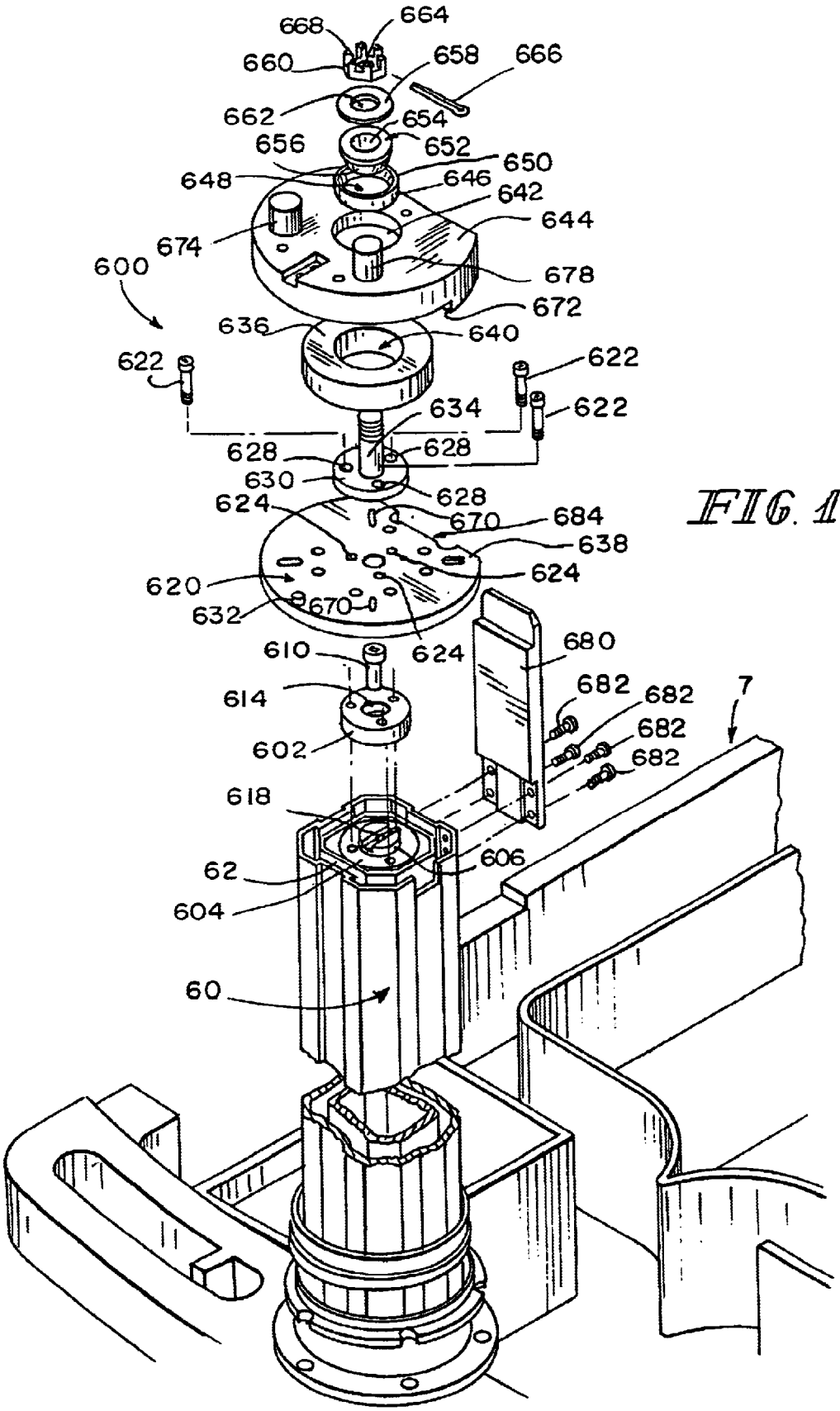
FIG. 12 is an exploded view of another embodiment of the home-position apparatus.

Another embodiment of the home-position apparatus is shown in FIGS. 12 through 16 and indicated by reference numeral 600. Specifically, FIG. 12 shows an exploded view of apparatus 600 which includes a bushing 602 that is secured to an internal drive shaft 604 of an inner member 62. Bushing 602 is attached to cap 606 of drive shaft 604 via fastener 610 that extends through bore 614 of bushing 602 and into bore 618 of cap 606. It is contemplated that drive shaft 604 is coupled to a motor (not shown) or other lifting mechanism (not shown) that selectively causes drive shaft 604, as well as inner telescoping member 62, to raise and lower.

A base plate 620 is attached to bushing 602 via fasteners 622 that extend through bores 628, 624 of plates 630, 620, respectively. Base plate 620 is, thus, fixedly fastened to drive shaft 604. Base plate 620 provides support for apparatus 600. A dowel pin 632 is fitted into the perimeter of plate 620 with a portion extending upwardly from plate 620. Dowel pin 632 serves to limit the pivot movement of overhead arm 18 to about ninety degrees from either direction of home position 47, as will be discussed in further detail herein. (See FIG. 15.)

Figure 13:
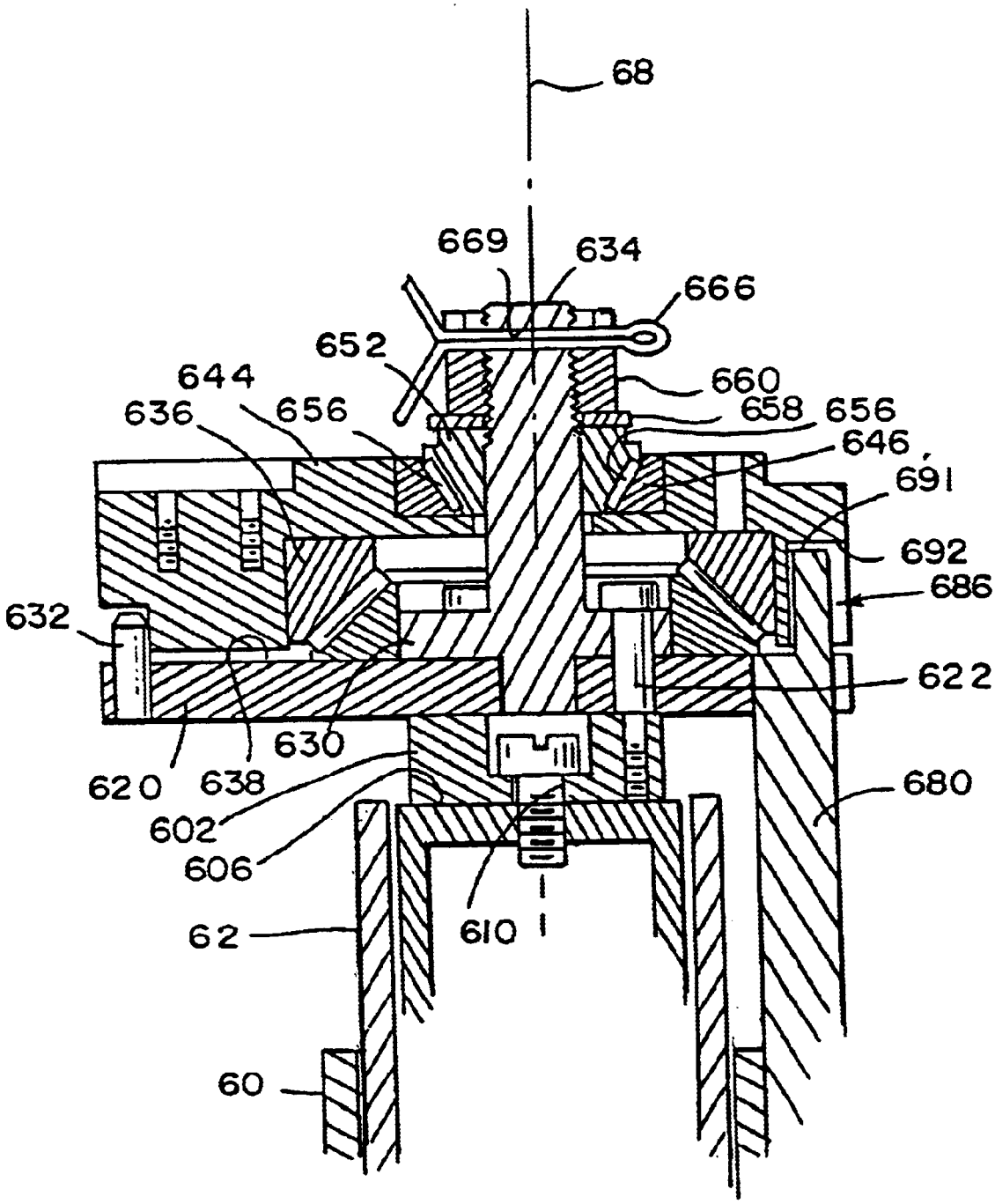
FIG. 13 is a cross-section view of the home-position apparatus of FIG. 12.

A bearing post 634 extends upwardly from plate 630. Bearing post 634 defines axis 68 about which plate 620 pivots. A thrust bearing 636 is located about plate 630 and is supported on the surface 638 of plate 620. (See FIG. 13.) Bearing post 634 extends through bore 640 of thrust bearing 636, as well as bore 642 of plate 644. Plate 644 is configured to pivot about axis 68. Specifically, plate 644 is supported as well as pivots on thrust bearing 636, as shown in FIG. 13. In addition, a bearing race 646 includes a bore 648 through which bearing post 634 extends. Bearing race 646 is seated within bore 642 of plate 644. Illustratively, bearing race 646 is friction fitted into bore 642. An angled bearing surface 650 is formed on the periphery of bore 648 of bearing race 646. A tapered roller bearing 652, also having a bore 654 disposed therethough and through which bearing post 634 extends, includes an angled bearing surface 656. The angle of bearing surface 656 of roller bearing 652 is configured to be complimentary to the angle of bearing surface 650 of bearing race 646. Accordingly, bearing surface 656, in conjunction with thrust bearing 636, provides a smooth pivot motion of plate 644 relative to plate 620. This translates into a smooth pivot motion for canopy 20 relative to base 7. (See FIGS. 1 and 15, for example.)

Plate 644 is secured to apparatus 600 by washer 658 and nut 660. Washer 658 includes a hole 662 through which bearing post 634 extends. Nut 660 also has a hole 664 also through which bearing post 634 extends. A cotter pin 666 extends through a parapet 668 of nut 660, through transverse bore 669 disposed through bearing post 634, and a second, coaxially aligned parapet 668 of nut 660, to further secure apparatus 600.

Extending downwardly from plate 644 is a lip 672. Lip 672 extends the length of plate 644 and is configured to engage pin 632 when plate 644 pivots a predetermined amount. (See FIGS. 12 15 and 16.) Illustratively, lip 672 and pin 632 limit the movement of plate 644 to a range of one-hundred eighty degrees. Canopy 20, for example, is attached to plate 644 and is, thus, movable between home position 47 and ninety degrees in either direction of home position 47. (See FIG. 15.) It is contemplated that lip 672 can extend downwardly from plate 644 at any location to limit the range of movement of canopy 20 to any desired range along directions 54, 70. It is further contemplated that lip 672 might be eliminated completely to provide complete lateral movement of canopy 20 in directions 54, 70.

Figure 16:
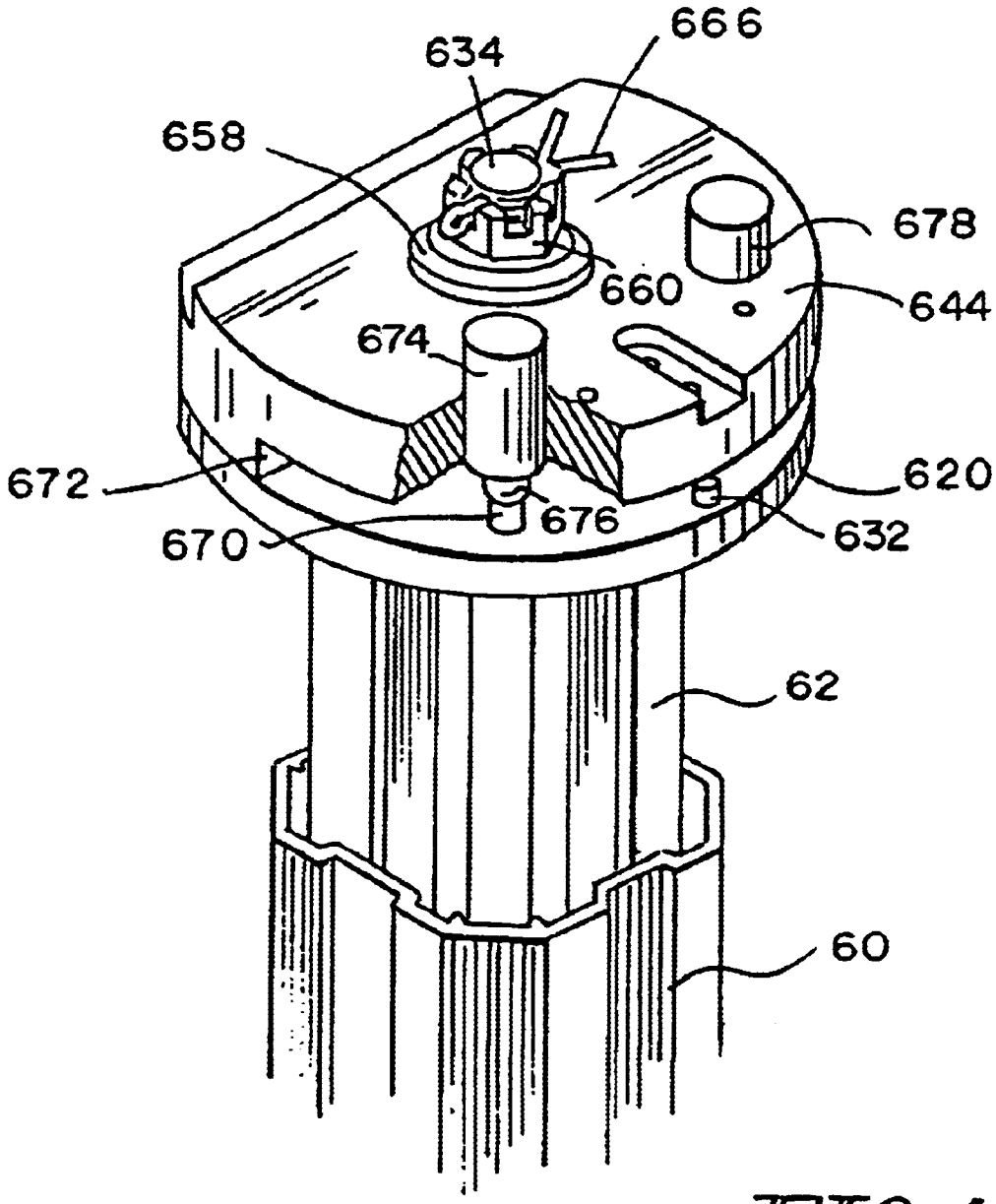
FIG. 16 is a rear perspective view of the vertical arm assembly of the home-position apparatus of FIG. 12, along with a broken-away view of a plunger.

As shown in FIG. 16, a pair of ball plungers 674, 678 extend through plate 644 and face surface 638 of plate 620. Plate 620 comprises selectively spaced detents 670, each configured to receive the ball-end 676 of one of either of the ball plungers 674, 678 when aligned therewith. Illustratively, the force of ball plungers 674, 678 is able to move overhead arm 18 to home position 47 from an offset angle of about four degrees, and the force required by a caregiver to disengage the plungers from the detent is about 4 lbs. The detents 670 are selectively spaced to receive plungers 674, 678 when canopy 20 is in a desired predetermined position to indicate to the caregiver that canopy 20 is in that position. For example, in the illustrated embodiment, plungers 674, 678 are located on plate 644 such that ball-end 676 is received in detent 670 when canopy 20 is in the home position 47, indicating the same to the caregiver. Alignment to home position 47 using ball plungers 674, 678 and detents 670 is repeatable within a tolerance of about 1/16 inch. It is appreciated that detents 670 can be placed in other locations on surface 638 of plate 620 to indicate to the caregiver, for example, when canopy 20 is ninety degrees in either direction from home position 47, or any other desired predetermined position.

Figure 14:
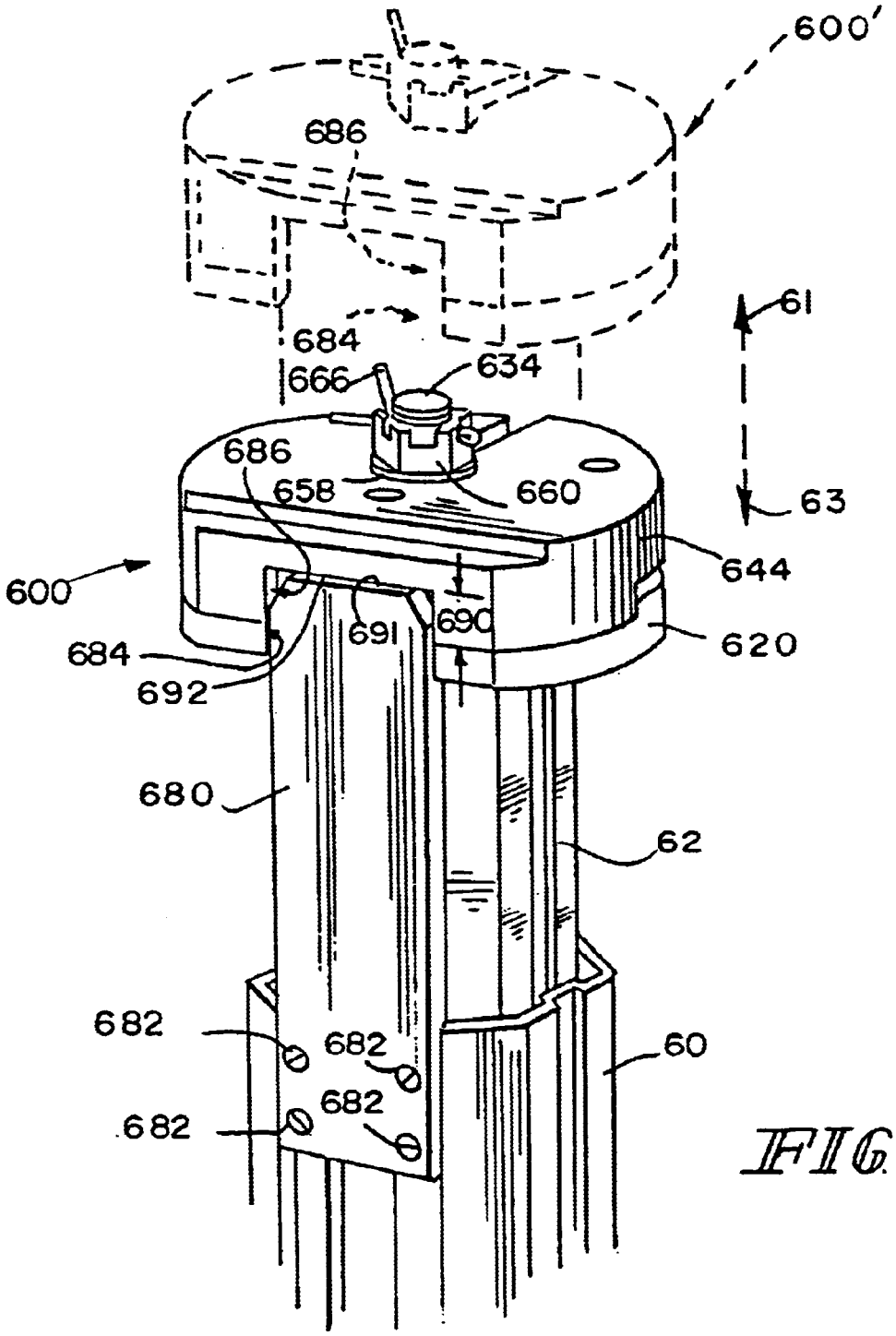
FIG. 14 is a front perspective view of the vertical arm assembly of the home-position apparatus of FIG. 12, shown in the lowered positioned by solid lines, and shown in the raised position by broken lines.

A stop plate 680, as shown in FIGS. 12 and 14, is used to limit movement of plate 644 relative to plate 620, and can define home position 47. Plate 680 is attached to outer telescoping member 60 by a plurality of fasteners 682. As inner telescoping member 62 moves upwardly in direction 61, assembly 600 is also raised as indicated by the broken lines of 600'. Both plates 620 and 644 comprise notches or recesses 684, 686, respectively, that both receive plate 680 when inner telescoping member 62 is in the lower position, as shown in FIG. 16. In this lower position, canopy 20 is in its lower use position to form the isolation chamber 12. (See, for example, FIGS. 1 and 12.) Stop plate 680 serves to prevent lateral movement of plate 644 relative to plate 620. When plate 680 is received in recesses 684, 686 canopy 20 is prevented from moving from home position 47. Inner telescoping member 62 is required to move upwardly in direction 61 so that plate 680 is cleared from at least recess 686 before plate 644 and, thus, canopy 620 can pivot in directions 54, 70. This feature prevents the caregiver from moving canopy 20 laterally without it being raised upward first, as previously describe with the prior embodiments. In this illustrated embodiment, inner telescoping member 62 moves upwardly in direction 61 a minimum amount that is just beyond the thickness 690 of recess 686 to allow plate 644 lateral movement relative to plate 620. Illustratively, that minimum amount is ⅝ inch which is sufficient for canopy 20 to clear the edges of the side and end of the support on the panels, depending on the configuration of the infant care unit.

Figure 15:
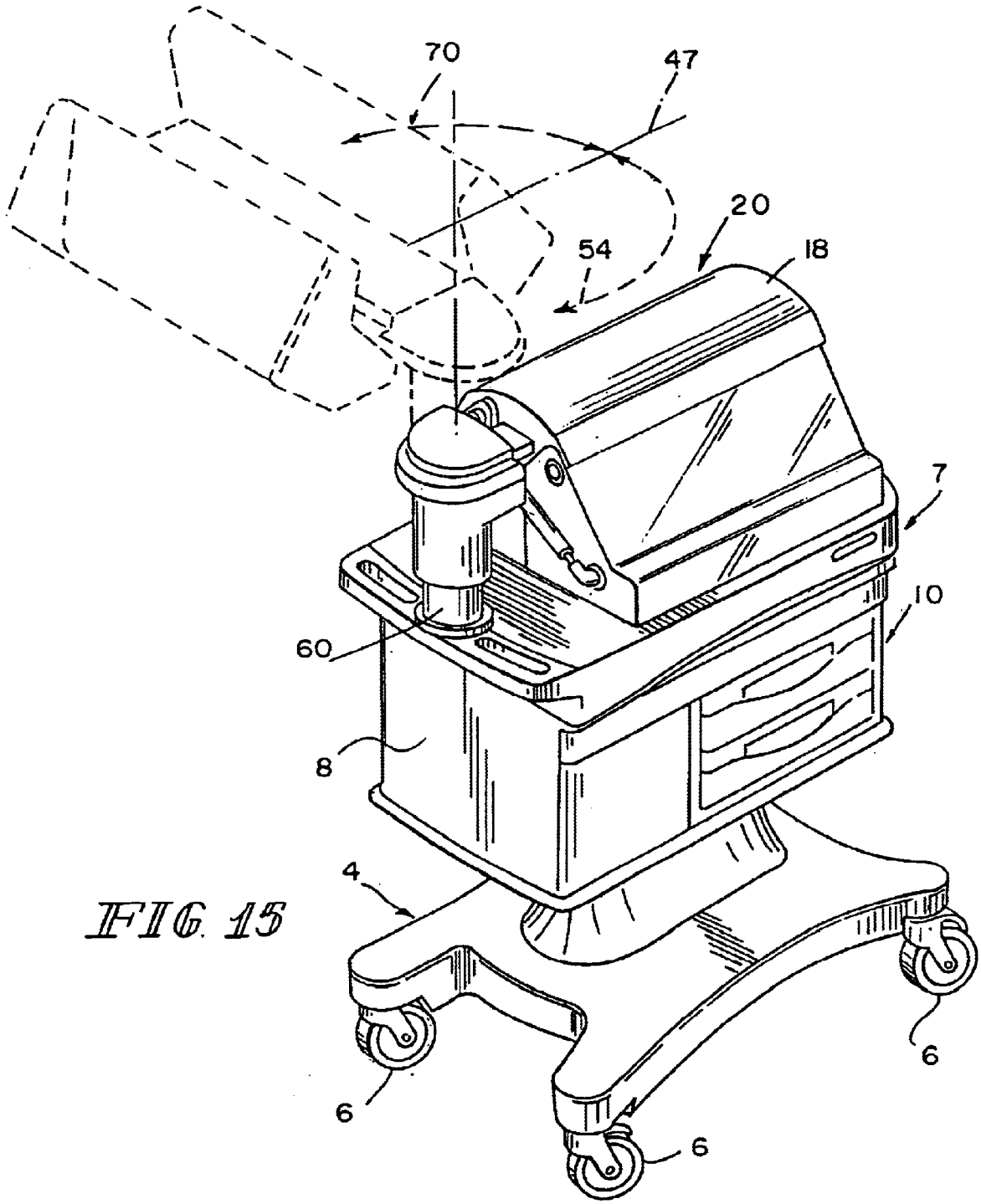
FIG. 15 is a perspective view of an infant care unit comprising the home-position apparatus of FIG. 12 showing the range of horizontal pivot of the canopy.

It is appreciated that stop plate 680 also serves to limit the downward travel of inner telescoping member 62. As inner telescoping member 62 is lowered in direction 63, as shown in FIG. 14, the top edge 690 of stop plate 680 engages and carries edge 692 of recess 686, thus, limiting the downward movement of inner telescoping member 62. This limit assists to establish the correct height of assembly 600 which coincides with the height of canopy 20 relative to support 7 as shown in FIG. 15, or side and end panels 24, 26, respectively, as shown in FIG. 1, depending on the specific configuration of the infant care unit.

Although the foregoing embodiments have been described, one skilled in the art can easily ascertain the essential characteristics of the apparatus, and various changes and modifications may be made to adapt the various uses and characteristics without departing from the spirit and scope of this application, as described by the claims which follow.

What is claimed is:

1. An infant care unit comprising a platform upon which an infant may rest, an overhead arm disposed relative to the platform and having a central position over the infant, the arm being movable from the central position to a position spaced therefrom, and a mechanism to maintain the overhead arm in its central position when it is returned from the position spaced therefrom.

2. The care unit of claim 1, comprising a support providing a vertical axis about which the overhead arm moves from its central position, the mechanism comprising a first plate which rotates about the axis with the overhead arm, the plate having a notch formed therein, and a locking member positioned into the notch when the overhead arm is in its central position.

3. The care unit of claim 2, wherein the support comprises telescoping members movable along the vertical axis and supporting the overhead arm in a lower use position and in a raised position spaced above the platform, the telescoping members comprise an outer telescoping member attached to the platform and an inner telescoping member movable relative to the outer telescoping member.

4. The care unit of claim 3, wherein the locking member is attached to the outer telescoping member and located in the notch when the overhead arm is in the lowered use and central position, and the locking member is spaced apart from the notch when the overhead arm is in the raised position.

5. The care unit of claim 4, wherein the support further comprises a second plate attached to the inner telescoping arm and movably positioned adjacent to the first plate, a stop is provided that engages the first and second plates preventing them from moving when the overhead arm is moved to the position spaced from the central position greater than 90 degrees.

6. The care unit of claim 1, wherein a canopy extends from the overhead arm configured to cover the infant and provide a controlled environment over the platform when the overhead arm is in the central position, the canopy being aligned with the platform when the overhead arm is in the central position.

7. The care unit of claim 1, comprising a heater configured to warm the infant when the overhead arm is in the central position.

8. The care unit of claim 5, wherein the second plate comprises a detent and the first plate comprises a locating member that engages the detent when the overhead arm is in the central position.

9. An infant-support apparatus comprising a base, an infant-support platform carried by the base, an overhead arm located generally above the infant-support platform, a mounting assembly configured to couple the overhead arm to the base for pivoting movement relative thereto in a second plane that is generally parallel to a first plane defined by the infant-support platform, and means for locking the overhead arm in the position generally above the infant-support platform.

10. The infant-support apparatus of claim 9, wherein the mounting assembly is pivotable between a central position and a position spaced therefrom, and the mounting assembly includes a mechanism for locating the overhead arm in the central position when it is returned from the position spaced apart therefrom.

11. The infant-support apparatus of claim 9, wherein the mounting assembly extends generally upwardly from the base, and the mounting assembly couples the overhead arm to the base for generally vertical movement relative thereto.

12. The infant-support apparatus of claim 9, further comprising a radiant heater mounted to the overhead arm and configured to direct heat toward the infant-support.

13. An infant care unit comprising:

a base;

an infant-support on the base and defining a central position;

a canopy arranged above the infant-support for movement from the central position which overlies the infant-support base to a position aside from the infant-support base, and a mounting assembly attached to the base and the canopy, the mounting assembly including a pivot mechanism configured to prevent movement of the canopy laterally in a plane above the infant-support between the central position and the position spaced aside therefrom, and the mounting assembly further including a stop member to prevent movement of the canopy laterally in a plane above the support beyond ninety degrees from the central position.

14. The infant care unit of claim 13, wherein the mounting assembly comprises upwardly extending telescoping members supporting the canopy in a lower use position cooperating with the infant-support to provide an enclosure for the infant, and in an upper position spaced above the infant-support.

15. The infant care unit of claim 13, wherein the mounting assembly includes a lock mechanism configured to permit the canopy to move laterally when the canopy is in its upper position spaced above the infant support.

16. An infant care unit comprising:

a base;

an infant-support on the base and defining a central position;

a canopy arranged above the infant-support; and a mounting assembly attached to the base and the canopy, the mounting assembly including a pivot mechanism configured to prevent movement of the canopy laterally in a plane above the infant-support between the central position and the position spaced aside therefrom, wherein the mounting assembly comprises upwardly extending telescoping members supporting the canopy in a lower use position cooperating with the infant-support to provide an enclosure for the infant, and in an upper position spaced above the infant-support, wherein the mounting assembly includes a lock mechanism configured to permit the canopy to move laterally when the canopy is in its upper position spaced above the infant-support, wherein the lock mechanism comprises a stop member attached to one of the upwardly extending telescoping members supporting the canopy, the stop member is engagable with the pivot mechanism when the canopy is in its lower use position to prevent lateral movement of the canopy.

17. The infant care unit of claim 16, wherein the pivot mechanism comprises a plate attached to the canopy and is rotatable about a vertical axis relative to the base, the plate having a notch formed therein, and the stop member is engagable with the notch when the canopy is in the central position.

18. The infant care unit of claim 17, wherein the plate further comprises a marker to indicate the central position.

19. The infant care unit of claim 17, wherein the plate further comprises a marker to indicate a position ninety degrees from the central position.

20. The infant care unit of claim 14, further comprising spaced-apart side and end walls extending upwardly about the infant-support, and having edges that mate with the canopy forming an isolation chamber about the infant-support when the canopy is in its central and lower use positions.

21. The infant care unit of claim 20, wherein the canopy further comprises downwardly extending side and end walls that form an isolation chamber about the infant-support when the canopy is in its lower use position.

22. A method of accessing an infant in an infant care unit, the method comprising:

providing a platform upon which the infant rests and a canopy positioned over the top of the platform forming an isolation chamber that defines a central position;

raising the canopy upwardly relative to the platform to a spaced-apart position; and moving the canopy laterally in a plane above the platform between the central position and a position spaced therefrom.

23. An infant care unit comprising:

a patient support;

a canopy forming an isolation chamber with the support and defining a central position and movable between a lower use position and an upper spaced-apart position;

means for disengaging and moving the canopy upwardly to its spaced-apart position; and means for supporting the canopy for rotation between the central position and a position spaced therefrom when the canopy is in its upper spaced-apart position.

24. An infant-support apparatus comprising a base, an infant-support platform carried by the base, an overhead arm located generally above the infant-support platform, and a mounting assembly configured to couple the overhead arm to the base, the mounting assembly comprising a stationary first plate and a second plate movable relative to the first plate in a second plane that is generally parallel to a first plane defined by the infant-support platform, the second plate comprising a plunger that is selectively engageable with at least one detent disposed in the first plate.

25. The infant care unit of claim 24, wherein the overhead arm is movable between a lowered use position and a raised spaced apart position.

26. The infant care unit of claim 25, wherein the first and second plates each comprise a slot, the slots being aligned with each other, and the infant care unit further comprising a stop member engaging the slots when the overhead arm is in the lowered use position to prevent movement of the second plate relative to the first plate, and disengaging at least the slot of the second plate when the overhead arm is in the raised spaced apart position to allow movement of the second plate relative to the first plate.

27. An infant-support apparatus comprising:

a base, an infant-support platform carried by the base, an overhead arm located generally above the infant-support platform, and a mounting assembly configured to coupled the overhead arm to the base, the mounting assembly comprising a stationary first plate and a second plate movable relative to the first plate in a second plane that is generally parallel to a first plane defined by the infant-support platform, wherein the overhead arm is movable between a lowered use position and a raised space apart position, and wherein the first and second plates each comprise a slot, the slots being aligned with each other, and the infant care unit further comprising a stop member engaging the slots when the overhead arm is in the lowered use position to prevent movement of the second plate relative to the first plate, and disengaging at least the slot of the second plate when the overhead arm is in the raised spaced apart position to allow movement of the second plate relative to the first plate.

* * * * *